US010773860B2

(12) United States Patent
Dabbur

(10) Patent No.: US 10,773,860 B2
(45) Date of Patent: Sep. 15, 2020

(54) METHOD FOR SAFE AND TIGHT CLOSURE USING SAFETY STRIP AND CAP FOR CLOSING BOTTLE'S NECK

(71) Applicant: AL IBTIKAR PACKAGING & INVESTMENT CO., LTD.

(72) Inventor: Ismail Omar Ismail Dabbur, Ramallah (PS)

(73) Assignee: AL IBTIKAR PACKAGING & INVESTMENT CO., LTD., Ramallah, The West Bank (PS)

( * ) Notice: Subject to any disclaimer, the term of this patent is extended or adjusted under 35 U.S.C. 154(b) by 617 days.

(21) Appl. No.: 14/339,645

(22) Filed: Jul. 24, 2014

(65) Prior Publication Data

US 2016/0023813 A1 Jan. 28, 2016

(51) Int. Cl.
*B65D 41/62* (2006.01)
*B65D 43/02* (2006.01)
*B65D 41/34* (2006.01)

(52) U.S. Cl.
CPC ..... *B65D 41/34* (2013.01)

(58) Field of Classification Search
CPC B65D 41/34; B65D 41/3409; B65D 41/3428; B65D 41/0485; B65D 41/04; B65D 41/48; B65D 41/0471; B65D 1/0238
USPC ..... 53/420; 215/252–256, 329–331; 220/265–266, 300–301, 293, 288
See application file for complete search history.

(56) References Cited

U.S. PATENT DOCUMENTS 2,387,439 A * 10/1945 Warth ..... B67B 3/2046 493/108
2,715,474 A * 8/1955 Phillips ..... B65D 41/045 215/347
3,019,931 A * 2/1962 Thornton ..... B65D 50/046 215/221
3,435,978 A * 4/1969 Wittwer ..... B65D 41/0471 215/217
3,567,057 A * 3/1971 Landen ..... B65D 50/046 215/221
3,744,655 A * 7/1973 Nixdorff, Jr. ..... B65D 50/046 215/216

(Continued)

FOREIGN PATENT DOCUMENTS

EP 0352962 A1 * 1/1990 ..... B65D 41/34
JP WO 2014080836 A1 * 5/2014 ..... B65D 41/0471

(Continued)

*Primary Examiner* — Nathaniel C Chukwurah
*Assistant Examiner* — Lucas E. A. Palmer
(74) *Attorney, Agent, or Firm* — Sughrue Mion, PLLC

(57) ABSTRACT

The present invention relates to absolute safe closure of beverages, food, medical bottles so that they cannot be opened and reclosed assuming the shape of first production in the factory. The first closing of the bottle's closure is only once in an absolute and tight manner, such that if the bottle is opened for the first time in any manner, it cannot be closed tightly and safely via intervention and engagement of the stopper with the neck of the bottle upon its closure for the first time. Using such closure manner, two parts are constituting one part such that they are non-detachable in any way, unless safety strip of stopper is tampered, that it cannot be reused as it was in the first case.

3 Claims, 4 Drawing Sheets

(56) References Cited

U.S. PATENT DOCUMENTS 3,748,816 A * 7/1973 Asmus ..... B65D 45/00 53/420
3,828,519 A * 8/1974 Levey ..... B65D 55/145 215/206
3,884,379 A * 5/1975 Landen ..... B65D 50/046 215/216
3,917,097 A * 11/1975 Uhlig ..... B65D 50/046 215/216
4,028,863 A * 6/1977 Nixdorff ..... B65D 50/046 53/420
4,105,132 A * 8/1978 Keeler ..... B65D 50/046 215/216
4,153,174 A * 5/1979 Keeler ..... B65D 41/3423 215/250
4,156,490 A * 5/1979 Peraboni ..... B65D 41/0414 215/252
4,432,462 A * 2/1984 Newkirk ..... B65D 55/026 116/201
4,494,664 A * 1/1985 Guala ..... B65D 41/3409 215/252
4,530,438 A * 7/1985 McDevitt ..... B65D 41/34 215/252
4,534,477 A * 8/1985 Laub, III ..... B65D 55/02 215/215
4,727,998 A * 3/1988 Simon ..... B65D 41/3404 215/230
4,828,127 A * 5/1989 Young ..... B65D 41/3414 215/252
4,834,252 A * 5/1989 Crisci ..... B65D 41/34 215/256
4,848,613 A * 7/1989 Nofer ..... B65D 41/3409 215/252
5,111,947 A * 5/1992 Patterson ..... B65D 41/3404 215/252
5,328,046 A * 7/1994 Kutz ..... B65D 21/022 206/509
5,715,977 A * 2/1998 Goncalves ..... B65D 41/0471 222/1
5,775,528 A * 7/1998 Wohlgemuth ..... B65D 41/3409 215/256
6,561,370 B1 * 5/2003 Escobar-Harrity ..... B65D 50/046 215/218
6,622,460 B2 * 9/2003 Gregory ..... B65D 41/045 215/252
7,156,248 B2 * 1/2007 Christophe ..... B65D 41/62 215/232
7,875,000 B2 * 1/2011 Krebs ..... A61M 1/06 604/523
8,528,759 B2 * 9/2013 Pucci ..... B65D 41/0471 215/253
2004/0200839 A1 * 10/2004 Conti ..... B65D 25/2888 220/288
2005/0269282 A1 * 12/2005 Luch ..... B29C 66/65 215/256
2010/0084364 A1 * 4/2010 Martin ..... B65D 41/34 215/201
2010/0308050 A1 * 12/2010 Gassner ..... B65D 41/3447 220/266
2011/0064537 A1 * 3/2011 Wrigley ..... A62B 9/00 411/315
2012/0279940 A1 * 11/2012 Giovannini ..... B65D 39/0052 215/329
2012/0324832 A1 * 12/2012 Stanek ..... B65D 43/0231 53/420
2015/0060457 A1 * 3/2015 Van Der Molen ..... B65D 75/5883 220/304
2015/0251820 A1 * 9/2015 Glaser ..... B65D 41/34 220/265

FOREIGN PATENT DOCUMENTS

WO WO 9414696 A1 * 7/1994 ..... B29C 45/0081
WO WO 2008072981 A2 * 6/2008 ..... B65D 41/34

* cited by examiner

METHOD FOR SAFE AND TIGHT CLOSURE USING SAFETY STRIP AND CAP FOR CLOSING BOTTLE'S NECK

FIELD OF THE INVENTION

The present invention relates to safety of beverages, food and medical products such that it is not possible to open and close it again in a sealable and safe manner as it was handled in the first time, for keeping the safety of product and health of the consumer, which is not available now.

BACKGROUND

The present invention arises from the need for keeping beverages, food and medical products safe and keeping it tamper proofed and ensuring safety and health of consumer which is not available now, after proving weaknesses and defects of closure method for containers of different kinds and shapes, any person can open any container, very simply and easily, and close it back as it was before with no marks indicating opening of the container and tampering it, thus making safety strip available in markets ineffective and can be penetrated, however there might be severe risk on the health and safety of consumer worldwide, what necessitates providing an alternative solution absolutely effective and safe, thus keeping product safe and keeping safety and health of consumer. What have been achieved in this invention is the impossibility of opening and reclosing a container and it assumes the previous state in any manner, wherein in any case of attempting to open the container in a conventional or indirect way, the seal got damaged and cannot be reused as it was first when provided with safety strip, as it was first produced which is not available now.

SUMMARY OF THE INVENTION

The invention related to safety of medical and food products currently available in markets characterized by safe closure is inadequate and does not fulfill the need for that due to said drawbacks, there is a need to amend and change this method to suitable with the desired full safety specification.

The previously mentioned drawback is that the stopper and the container are two separate parts and upon closure of the container provided with appropriate stopper they form two combined overlapped bodies so that the stopper closes the container in a sealed, but unsafe manner so that one can separate them from each other in a manner rather than normal opening, i.e. by heating the stopper and it got detached from the container after expansion by returning it back to its original position with safety strip as it was produced such that it can be reused again, further the neck of the bottle can be internally heated, detaching the stopper totally from the bottle by returning it back to its original position and reusing it several times thus container's content is at risk of being easily tampered.

Therefore the optimal solution provided by this invention is to make the two bodies, i.e. the container and stopper, one body upon the closure of the container with the stopper by intervention and engagement such that the stopper engages with the container by inserting a part of stopper into another part of the container forming one interposing part undetectable unless either the stopper, the container or both are tampered whish make it difficult to use them again in their first safe closure as they were first produced nor by any other way. By this method and this new aspect of forming one integral part of the stopper and the container upon closure, the closure characterized by safety once first and only once and cannot be reused again to avoid risks.

The change is achieving integrity and engagement of both stopper and container making it one part after closure and they cannot be detached in any way unless the stopper is tampered so it cannot be reused again as it was first safely used the issue that is actually required. Regardless of a currently present part over another without any engagement, except cutting safety strip by the edge of stopper separating the safety strip from the stopper

DETAILED DESCRIPTION

The present invention relates to safe and sealed closure method for the neck of food and medical bottle via intervention and engagement of the part of stopper into a part of the bottle's neck to be closed to tightly seal the container and product to deliver it safely to the consumer thus prevent occurrence of tampering after manufacturing the product and coming out of the plant, in this way the original product can be delivered with its desired quality to the consumer without any amendments in the product. the parts overlapped over each other may be shown in both of the stopper and the neck of the bottle to achieve absolute closure mentioned in the figures.

Figure 1:
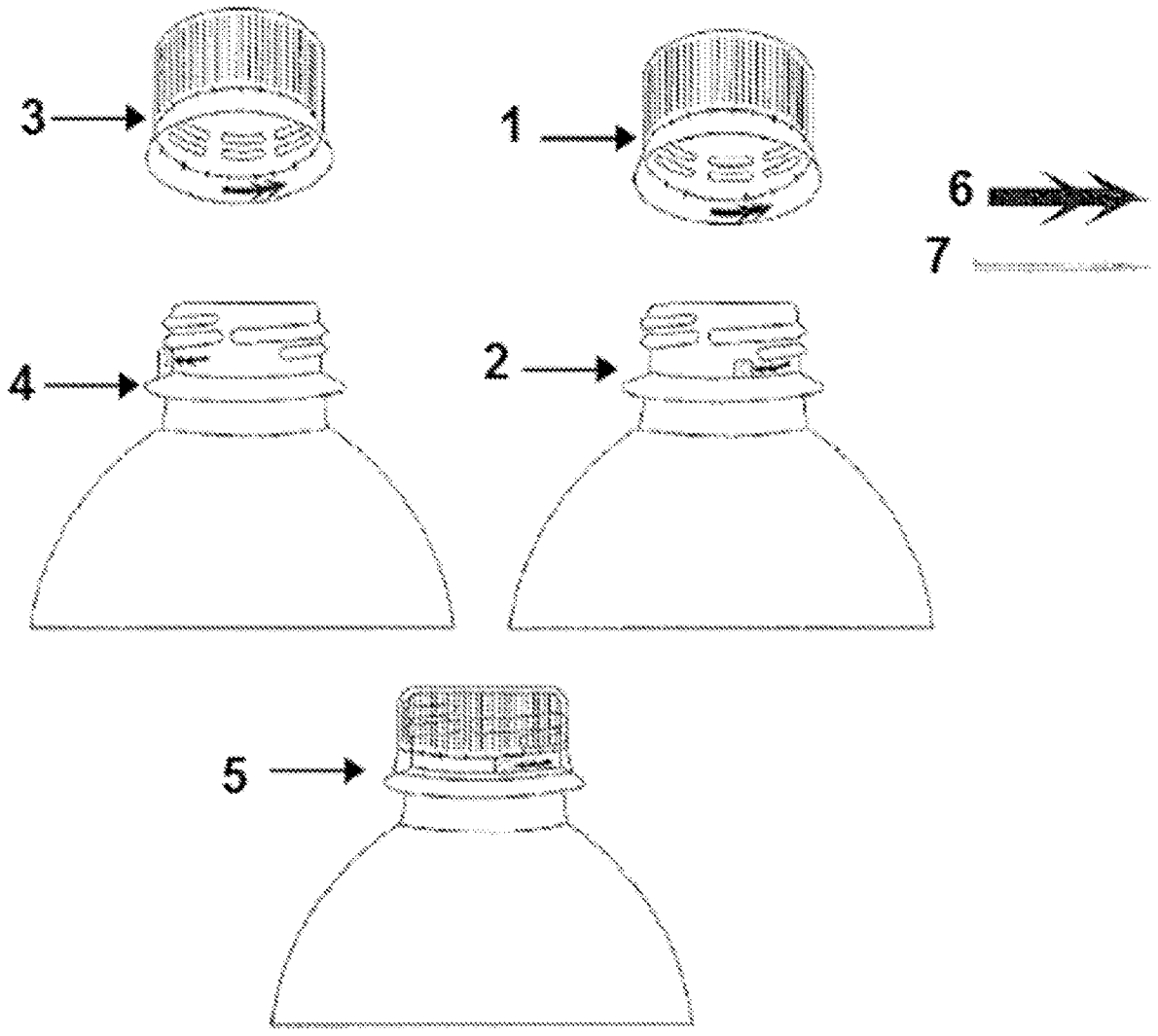
FIG. 1 shows the closure of a bottle to be sealed using a stopper provided with safety strip with ridge provided with lateral ends which move upon the entry of the ridge into the cap positioned on the container's neck.

FIG. 1 shows the closure of a bottle to be sealed, in the following we will describe the numbers used in the figures:

- (1) is the profile of the stopper with the ridge on the safety strip which is the safety element that enters into the cap positioned on the container's neck.
- (2) is a front view of the cap on the container's neck and how it enters into the ridge i.e. (safety element) of safety strip present on the stopper.
- (3) is a profile of the stopper of number (1)
- (4) is a profile of the cap on the container's neck and how it enters the ridge (safety part) of safety strip present on the stopper.
- (5) is a front view of the stopper on the neck of the container in the final position upon its closure and entry of the ridge from safety strip into the cap positioned on the neck of the container.
- (6) is a front view of safety part provided with safety strip (the ridge) of the stopper and the essential parts in it is the lateral ends which move upon the entry of the ridge into safety cap after the stopper entered it returns to its current position, wherein through the stopper closure can be achieved so that the entry is one way.

(7) is a profile of safety part (the ridge) with safety strip of the stopper.

Figure 2:
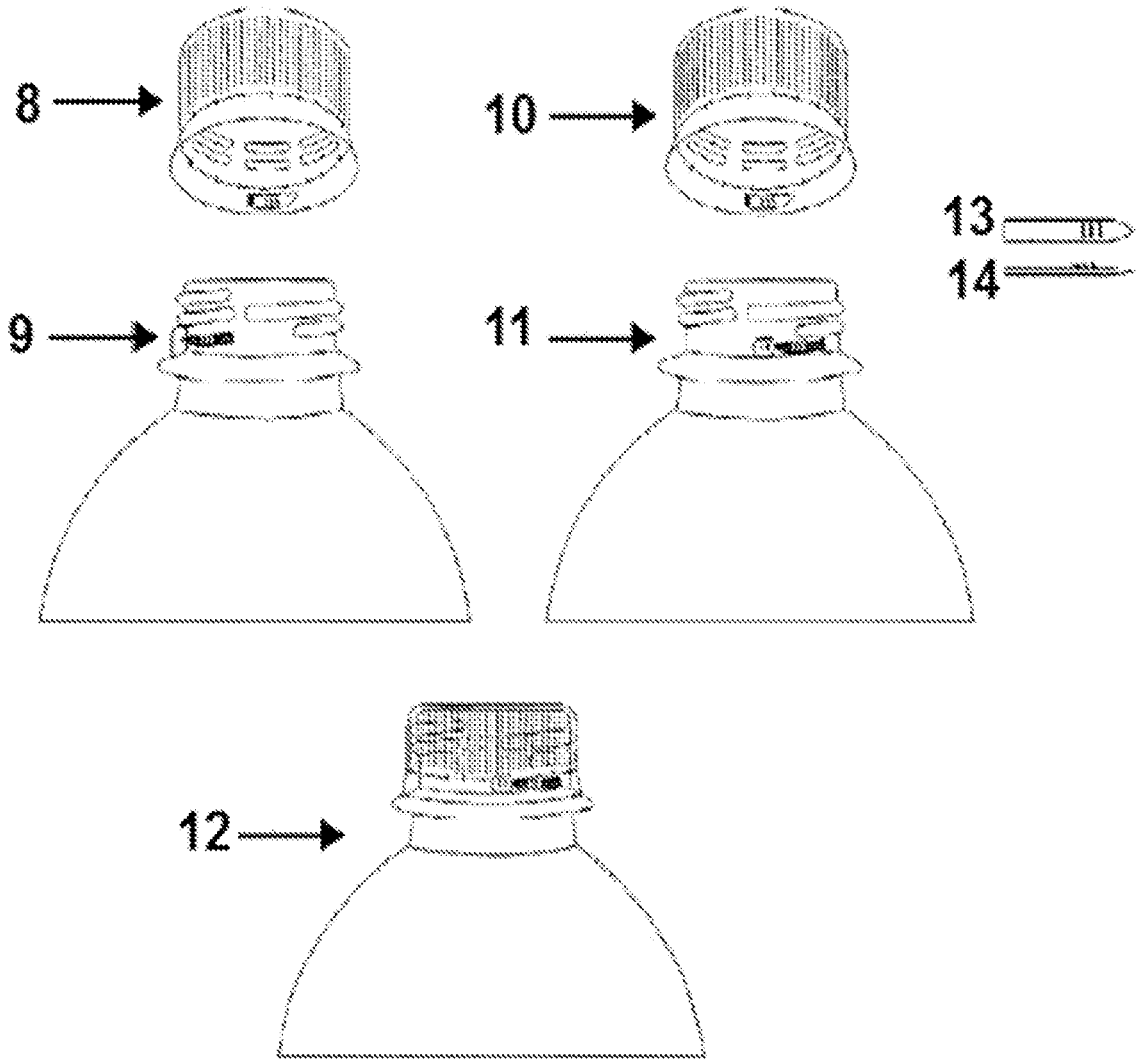
FIG. 2 shows the closure method using a stopper provided with a safety strip with ridges however the grooves are behind the ridge, wherein the stopper enters into the cap positioned on the container's neck.

FIG. 2 shows closure method of the bottle to be sealed with different shape of the ridge used into the stopper. Herein below we will describe said numbers in the following:

(8) is the profile of the stopper with the ridge on the safety strip which is a safety part that enters into the cap positioned on the container's neck.

(9) is a profile of the cap on the container's neck and how it enters the ridge (safety part) of safety strip present on the stopper.

(10) is a profile of the stopper like number (8).

(11) is a front view of the cap on the container's neck and how it enters into the ridge i.e. (safety element) of safety strip present on the stopper.

(12) is a front view of the stopper on the neck of the container in the final position upon its closure and entry of the ridge from safety strip into the cap positioned on the neck of the container.

(13) is a front view of safety part provided with safety strip (the ridge) of the stopper with relative difference in the ridge i.e. safety part positioned on the safety strip in the stopper the difference is the place of the grooves instead of being on the sides of the ridge (safety part) as in figure number 1 it is on the back as well as the cap the place of grooves changed according to its change in (the ridge) safety part that enters into the cap.

(14) is a profile of safety part (the ridge) with a safety strip of the stopper.

Figure 3:
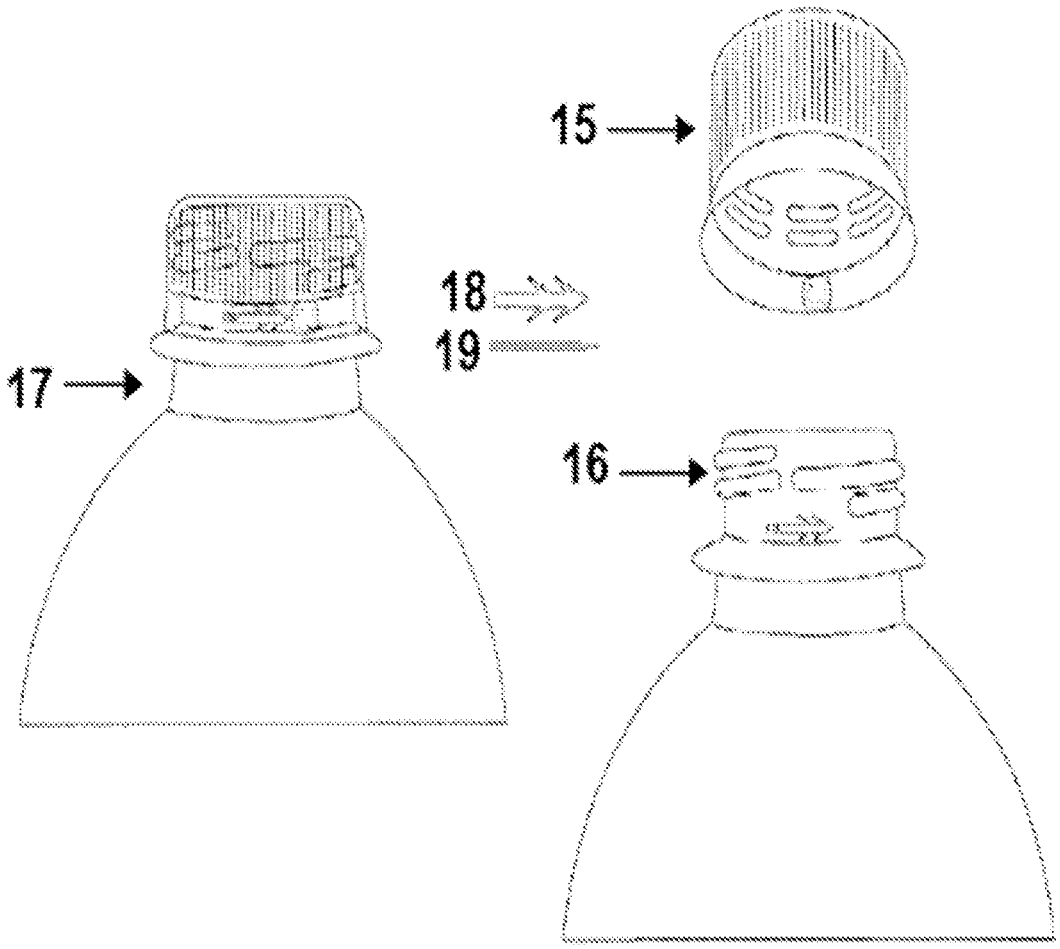
FIG. 3 shows the closure of the bottle in the other figure using a stopper containing a cap thereby the ridge with lateral ends (grooves) i.e. safety element is on the bottle's neck to be closed.

FIG. 3 shows closure method of the bottle to be sealed by varying the place of safety strip and the cap used in both stopper and bottle's neck in the following said exemplary number will be described herein:

(15) is a front view of the cap on the safety strip in the stopper in contrary with part number (1) in FIG. 1 wherein the ridge is on the stopper and the cap is on the container and vice versa wherein the cap becomes on the stopper and the ridge i.e. safety part is on the container's neck.

(16) is a front view of safety part (the ridge) on the container's neck that enters into the cap positioned on the safety strip of the stopper in contradiction with part (2) in FIG. 1 wherein the ridge is on the safety strip of the stopper and the cap is on the neck of the container.

(17) is a front view of the stopper for its final position on the neck of the container in the closed position when entering (the ridge) safety part into the cap on contrary to part (5) in FIG. 1 so that the moving part is the cap and the stator is the ridge in the neck of the container thus the cap enters into the ridge contrary to FIG. 1 part (5) wherein the ridge is movable and it enters into the cap mounted on container's neck.

(18) is a front view of safety part (the ridge) on container's neck.

(19) is a profile of safety part (the ridge) which is on the neck of the container.

Figure 4:
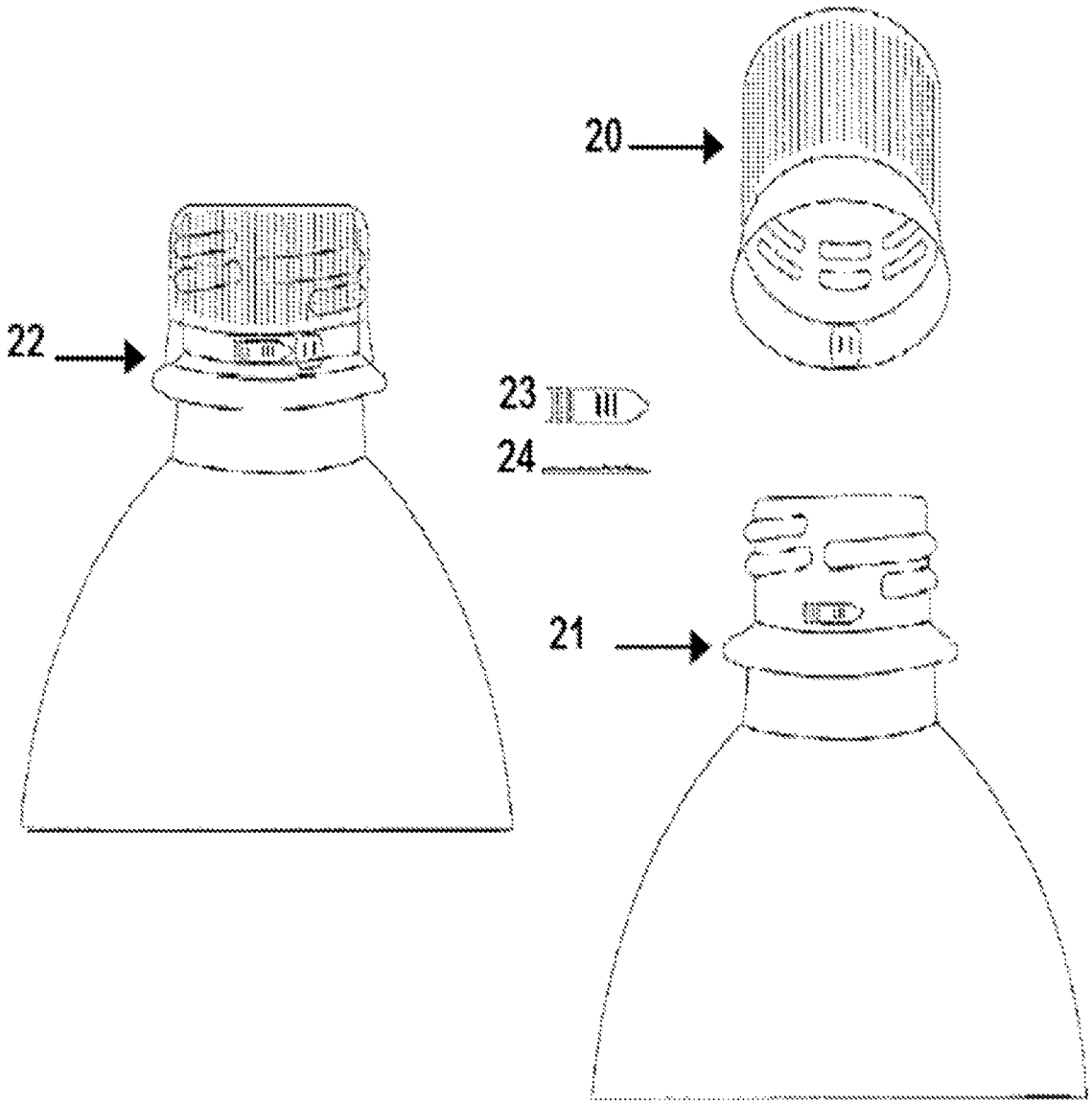
FIG. 4 shows closure method via intervention and engagement using a stopper provided with a cap enters into the ridge and the grooves are on the back inside the bottle's neck.

FIG. 4 shows closure method of the bottle to be sealed with different shape of the ridge used provided with safety strip present on bottle's neck and by varying the place of the cap since in such a case it is on the stopper, in the following said exemplary number will be described herein:

(20) is a front view of the cap on the safety strip in the stopper that enters into the ridge i.e. safety part present on the container's neck.

(21) is a front view of safety part (the ridge) on the container's neck that enters into the cap positioned on the safety strip of the stopper with relative difference in the ridge i.e. safety part positioned on the safety strip in the stopper the difference is the place of the grooves instead of being on the sides of the ridge (safety part) as in FIGS. 1 and 3 it is on the back as well as the cap the place of grooves changed according to it's change in (the ridge) safety part that enters into the cap.

(22) is a front view of the stopper for its final position on the neck of the container in the closed position when entering (the ridge) safety part of the cap so that the moving part is the cap and the stator is the ridge in the neck of the container.

(23) is a front view of safety part (the ridge) present on container's neck.

(24) is a profile of safety part (the ridge) present on the neck of the container.

Safety part (the ridge) (1, 3) shown in FIG. 1 is represented by an arrow and is attached to safety strip present in the stopper from the left end and the remaining part is detached from safety strip so that it enters into safety cap on the neck of the container without exiting, thereby the aimed goal can be achieved which is the integration of two bodies together (the stopper and neck of the container) such that they became one or two non-detachable unless the stopper or both parts are tampered, as required.

The ridge contains moving parts as fins that folds upon entry into the cap then it opens inside to prevent exit of the ridge without disrupting safety strip, such fins or moving parts of the ridge is positioned on the sides.

However, safety part (the ridge) (8, 10) shown in FIG. 2 has different shape together with appropriate difference in the shape of the cap in the neck of the container.

The difference is that the ridges, i.e. moving parts that lead to closure of the stopper with the neck of the container are positioned behind the ridge on not on the sides but it have the same functions in a different way and they may have different various shapes, achieving the same role of absolute closure.

The cap (2, 4) shown in FIG. 1 is positioned on the container's neck which is a part that enters into the ridge and shows how it enters into the ridge in one way direction, i.e. entry without exit thereby safety strip is disrupted in the stopper when it is opened.

The cap (9, 11) shown in FIG. 2 present on the neck of the container enters into the ridge in a different shape, which is appropriate with the shape of the ridge which differs in FIG. (1, 3).

Using integrity and engagement method tight closure can be achieved as shown in FIG. 1, the figure also shows the final shape upon closure (5) and how the ridge enters into the cap in its final stages, safe closure is achieved since the ridge enters into the cap in one irreversible way, there by safety strip of the stopper can be cut upon opening of the container, they are non-detachable from one another in any way unless the stopper is tampered and the safety strip is cut, because it's impossible to reach it as it is positioned between the stopper's wall and the wall of container's neck.

The present invention discloses a closure method using safety part (the ridge) that enters into the cap and keeping products safe as required, the safety part takes two different shapes, so it can alternates the position of the ridge also once on the safety strip and another on the container's neck as shown in FIG. 3 such that it is present on container's neck (16) with its rear end contacting the neck of the container, being separated from the neck of the container by its front part such that it can enter the cap positioned on the safety strip present on the stopper.

What is claimed is:

1. A food and medical bottle comprising:

a neck;

a screw cap for closing the food and medical bottle; and a safety device, the safety device comprising a closure part fixed to the screw cap and another closure part fixed to the neck, wherein a first closure part, among the closure part fixed to the screw cap and the other closure part fixed to the neck, is formed as a safety strip in the shape of plural connected arrows that are formed by means of fins on lateral sides of the safety strip and each having a V-shape, wherein a second closure part, different from the first closure part and among the closure part fixed to the screw cap and the other closure part fixed to the neck, is formed in such a way that the fins formed in the V-shape may pass through an opening of the second closure part by folding the corresponding V-shape and return to the V-shape after having passed through, wherein the second closure part breaks the safety strip upon a return movement of the first closure part, and wherein the second closure part surrounds the first closure part above, below, and on the lateral sides of the safety strip having passed through the opening of the second closure part.

2. The food and medical bottle according to claim 1, wherein the safety strip is formed in the shape of a double arrow.

3. The food and medical bottle according to claim 1, wherein the first closure part is fixed to the neck and the second closure part is fixed to the screw cap.

* * * * *